US007830406B2

(12) United States Patent
Horikawa

(10) Patent No.: US 7,830,406 B2
(45) Date of Patent: Nov. 9, 2010

(54) LED PRINTER AND PRINT CONTROL METHOD

(75) Inventor: Minoru Horikawa, Chiba (JP)

(73) Assignee: Seiko I Infotech Inc. (JP)

( * ) Notice: Subject to any disclaimer, the term of this patent is extended or adjusted under 35 U.S.C. 154(b) by 273 days.

(21) Appl. No.: 12/070,326

(22) Filed: Feb. 14, 2008

(65) Prior Publication Data

US 2008/0252713 A1 Oct. 16, 2008

(30) Foreign Application Priority Data

Feb. 20, 2007 (JP) ..... 2007-039031
Nov. 14, 2007 (JP) ..... 2007-295617

(51) Int. Cl.
*B41J 2/435* (2006.01)
*B41J 2/47* (2006.01)

(52) U.S. Cl. ..... 347/234; 347/248

(58) Field of Classification Search ..... 347/129, 347/136, 171, 234, 235, 238, 248–250
See application file for complete search history.

(56) References Cited

U.S. PATENT DOCUMENTS 4,318,597 A * 3/1982 Kotani et al. ..... 396/549
4,435,064 A * 3/1984 Tsukada et al. ..... 355/1
4,903,067 A * 2/1990 Murayama et al. ..... 347/129
4,965,597 A 10/1990 Ohigashi et al. ..... 346/157
5,003,323 A * 3/1991 Onuki et al. ..... 347/171
5,260,718 A * 11/1993 Rommelmann et al. ..... 347/136
2002/0001494 A1 1/2002 Futagawa ..... 399/396
2002/0106228 A1 8/2002 Asuwa et al. ..... 399/384

FOREIGN PATENT DOCUMENTS

JP 08272176 10/1996
JP 2000190564 7/2000
JP 2002019178 1/2002
JP 2003283609 10/2003

* cited by examiner

*Primary Examiner*—Hai C Pham
(74) *Attorney, Agent, or Firm*—Adams & Wilks

(57) ABSTRACT

An LED printer has a photosensitive drum, a resist roller for feeding a printing medium to the photosensitive drum at a first constant speed, a fixing device for discharging the printing medium from the photosensitive drum at a second constant speed, a separation type LED head arranged zigzag, and a printing control circuit for detecting a position of the printing medium fed by the resist roller or the fixing device and adjusting printing timings of the first portion LED head and the second portion LED head based on the detected position and the LED head interval. The LED printer can normally correct a print length in each of a front end region and a rear end region of a sheet.

8 Claims, 9 Drawing Sheets

LED PRINTER AND PRINT CONTROL METHOD

BACKGROUND OF THE INVENTION

1. Technical Field

The present invention relates to a technique for controlling an LED printer and, more particularly, to a technique for controlling an LED printer using a separation type LED head.

2. Background Art

A conventional printing process using an LED printer is performed as follows. Flash light emission (exposure) is performed using an LED head opposed to a photosensitive drum based on print data supplied from the outside to form an electrostatic latent image on the photosensitive drum. The electrostatic latent image formed on the photosensitive drum is supplied with toner and developed by a developing device. A toner image formed by developing is transferred by a transfer device onto a sheet fed from a resist roller and deposited thereon.

After that, the toner deposited on the sheet is fixed to the sheet by a fixing device while the sheet is discharged, so printing is completed. Note that the LED printer is controlled by a printing control circuit.

In particular, in the printing process using the LED printer, the sheet is fed by the photosensitive drum provided in a central portion, the resist roller for feeding the sheet, and the fixing device for discharging the sheet. A sheet feeding speed of the resist roller and a sheet feeding speed of the fixing device are each held to a constant value and set such that the sheet feeding speed of the fixing device becomes faster than the sheet feeding speed of the resist roller in order to stably feed the sheet.

Therefore, a phenomenon occurs in which the sheet feeding speed of the sheet is changed among a front end region in which the sheet does not reach the fixing device and thus the sheet is fed by only the resist roller, a central region in which the sheet is fed by both the fixing device and the resist roller, and a rear end region in which the sheet is released from the resist roller and thus the sheet is fed by only the fixing device.

A rotational speed of the photosensitive drum is normally set corresponding to the sheet feeding speed in the central region of the sheet. Therefore, unlike the central region of the sheet, a print length in a sub scanning direction is not normally printed on each of the front end region and the rear end region of the sheet.

For example, as shown in FIG. 9A, when two parallel lines having an interval in the sub scanning direction which is "a2" are to be printed on each of the front end region, the central region, and the rear end region of the sheet, the two parallel lines having the interval "a2" are normally printed on the central region of the sheet.

However, the interval in the sub scanning direction is "a1" in the front end region of the sheet, so the two parallel lines are printed at an interval narrower than the interval "a2".

In contrast to this, the interval in the sub scanning direction is "a3" in the rear end region of the sheet, so the two parallel lines are printed at an interval wider than the interval "a2".

Note that in each of the front end region and the rear end region of the sheet, because the rotational speed of the photosensitive drum is different from the sheet feeding speed of the sheet, printing is made with slipping.

Note that the sub scanning direction is a direction in which the sheet is transported and hereinafter, the sub scanning direction is referred to as a direction X. The description will be made based on the assumption that a direction which is orthogonal to the sub scanning direction X and corresponds to an extension direction of a rotating shaft of the photosensitive drum is a main scanning direction Y.

A technique disclosed in Japanese Patent Application Laid-open No. 2001-923226 has been known as a technique for avoiding a change of the print length in the sub scanning direction which is caused by the difference between the rotational speed of the photosensitive drum and the sheet feeding speed.

In the technique disclosed in Japanese Patent Application Laid-open No. 2001-923226, a cycle of exposure to the photosensitive drum is made variable between the front end region and the rear end region of the sheet relative to the central region thereof, thereby correcting the print length in the sub scanning direction in each of the front end region and the rear end region.

Incidentally, in recent years, in order to reduce a cost of an LED head for performing exposure on the photosensitive drum, a separation type LED head which is separated into a plurality of (three to five) LED heads in the main scanning direction or an LED head in which a plurality of (three to five) small-size LED heads are arranged in the main scanning direction has been become mainstream in large-size LED printers.

Such an LED head is hereinafter referred to as a "separation type LED head". Unlike the separation type LED head, an LED head which is not separated into a plurality of parts in the main scanning direction is referred to as a "single type LED head" and the description will be made.

The separation type LED head includes the small-size LED heads arranged in the main scanning direction, so the respective LED heads are overlapped to be shifted in the sub scanning direction by several mm to several cm.

Reference printing positions of the respective LED heads in the sub scanning direction are different from one another. Therefore, a joint correction circuit is provided to a printing control circuit of the respective LED heads to obtain the same print quality as that of the single type LED head.

The LED printer device described in Japanese Patent Application Laid-open No. 2001-923226 has a structure in which the cycle of exposure to the photosensitive drum is made variable to correct the print length in each of the front end region and the rear end region of the sheet in the case where the single type LED head is used.

However, when the separation type LED head instead of the single type LED head is used in the LED printer device described in Japanese Patent Application Laid-open No. 2001-923226, there is a problem that normal printing is not performed because joint correction timings of the respective LED heads of the separation type LED head which are shifted in position in the sub scanning direction are changed.

In other words, there is a problem that the prints in the main scanning direction are not joined and thus the print length in each of the front end region and the rear end region cannot be normally corrected, thereby reducing printing precision (see FIG. 9B).

SUMMARY OF THE INVENTION

The present invention has been made in view of the above-mentioned circumstances. An object of the present invention is to provide an LED printer which uses the separation type LED head and can normally correct the print length in each of the front end region and the rear end region of the sheet.

The present invention has been made to solve the above-mentioned problem. In a first aspect, the present invention is directed to an LED printer comprising: a photosensitive drum which rotates about a rotating shaft in a sub scanning direction; a resist roller for feeding a printing medium to the photosensitive drum at a first constant speed; a fixing device for discharging the printing medium from the photosensitive drum at a second constant speed different from the first constant speed; a separation type LED head which includes a first portion LED head and a second portion LED head, the first portion LED head and the second portion LED head being arranged parallel to a main scanning direction at an LED head interval which is a predetermined interval in the sub scanning direction while end portions thereof are overlapped with each other; and a printing control circuit for detecting a position of the printing medium fed by the resist roller or the fixing device and adjusting printing timings of the first portion LED head and the second portion LED head based on the detected position and the LED head interval.

In one embodiment, the LED printer according to the foregoing aspect is characterized in that: the first portion LED head is disposed before the second portion LED head relative to the rotation of the photosensitive drum; and the printing control circuit: has a line clock pulse signal outputted at a reference cycle corresponding to the LED head interval in the position of the printing medium in which the printing medium is fed by the resist roller and the fixing device; sets print timings of the first portion LED head and the second portion LED head as a timing of the line clock pulse signal outputted at the reference cycle when the detected position is the position of the printing medium in which the printing medium is fed by the resist roller and the fixing device; delays a cycle of the reference cycle and sets the print timing of the first portion LED head as a timing delayed by a predetermined time from the line clock pulse signal outputted at the delayed reference cycle, when the detected position is the position of the printing medium in which the printing medium is fed by only the resist roller; and advances the cycle of the reference cycle and sets the print timing of the second portion LED head as a timing delayed by a predetermined time from the advanced reference cycle, when the detected position is the position of the printing medium in which the printing medium is fed by only the fixing device.

In another embodiment, the LED printer according to the foregoing aspect is characterized in that: the first portion LED head is disposed before the second portion LED head relative to the rotation of the photosensitive drum; and the printing control circuit: has a line clock pulse signal outputted at a reference cycle corresponding to the LED head interval in the position of the printing medium in which the printing medium is fed by the resist roller and the fixing device; sets the print timing of each of the first portion LED head and the second portion LED head as a timing of the line clock pulse signal outputted at the reference cycle when the detected position is the position of the printing medium in which the printing medium is fed by the resist roller and the fixing device; delays a cycle of the reference cycle and sets the print timing of the second portion LED head as a timing advanced by a predetermined time from the line clock pulse signal outputted at the delayed reference cycle, when the detected position is the position of the printing medium in which the printing medium is fed by only the resist roller; and advances the cycle of the reference cycle and sets the print timing of the first portion LED head as a timing advanced by a predetermined time from the advanced reference cycle, when the detected position is the position of the printing medium in which the printing medium is fed by only the fixing device.

In another embodiment, the LED printer according to any of the foregoing embodiments is characterized in that the printing control circuit changes the cycle of the reference cycle in a stepwise manner.

In another embodiment, the LED printer according to any of the foregoing embodiments is characterized in that the printing control circuit changes the predetermined time for delaying or advancing from the line clock pulse signal in the stepwise manner.

In another embodiment, the LED printer according to any of the foregoing embodiments is characterized in that: the LED printer includes a resist sensor for outputting a printing medium feed start signal when it is detected that the printing medium is fed to the resist roller; and the printing control circuit detects the position of the printing medium in which the position of the printing medium is a position of the resist roller when the printing medium feed start signal is inputted.

In another embodiment, the LED printer according to any of the foregoing embodiments is characterized in that the printing control circuit includes: a line clock set frequency storage section for storing a line clock set frequency which is a frequency of a line clock pulse signal corresponding to a reference print timing of the separation type LED head; a line clock generating circuit for generating the line clock pulse signal at the line clock set frequency; a line clock pulse signal counter circuit for counting the line clock pulse signal as a line clock pulse signal count value; a first boundary value storage section for storing a first line clock pulse signal counter value corresponding to a boundary position between a front end region in which the printing medium is transported by only the resist roller and a central region in which the printing medium is transported by the resist roller and the fixing device; a second boundary value storage section for storing a second line clock pulse signal counter value corresponding to a boundary position between the central region and a rear end region in which the printing medium is transported by only the fixing device; an L1 comparator circuit for comparing the line clock pulse signal count value with the first line clock pulse signal counter value and outputting an L1 detection signal when a comparison result is matched; an L2 comparator circuit for comparing the line clock pulse signal counter value with the second line clock pulse signal counter value and outputting an L2 detection signal when a comparison result is matched; a line clock set frequency correction circuit for adjusting the line clock set frequency stored in the line clock set frequency storage section in response to an input of the L1 detection signal or the L2 detection signal, corresponding to the front end region, the central region, or the rear end region; a first delay time calculation section for calculating a first delay time between the line clock pulse signal and printing made by the first portion LED head in response to the input of the L1 detection signal; a second delay time calculation section for calculating a second delay time between the line clock pulse signal and printing made by the second portion LED head in response to the input of the L2 detection signal; a first LED head control circuit for delaying the printing made by the first portion LED head by the calculated first delay time from an input of the line clock pulse signal generated by the line clock generating circuit; and a second LED head control circuit for delaying the printing made by the second portion LED head by the calculated second delay time from the line clock generated by the line clock generating circuit.

In a second aspect, the present invention is directed to a print control method for an LED printer, comprising: a photosensitive drum which rotates about a rotating shaft in a sub scanning direction; a resist roller for feeding a printing medium to the photosensitive drum at a first constant speed; a fixing device for discharging the printing medium from the photosensitive drum at a second constant speed different from the first constant speed; a separation type LED head which includes a first portion LED head and a second portion LED head, the first portion LED head and the second portion LED head being arranged parallel to a main scanning direction at an LED head interval which is a predetermined interval in the sub scanning direction while end portions thereof are overlapped with each other; and a printing control circuit for adjusting printing timings of the first portion LED head and the second portion LED head, the print control method being characterized by comprising the steps of: detecting a position of the printing medium fed by the resist roller or the fixing device; and adjusting the printing timings of the first portion LED head and the second portion LED head based on the detected position and the LED head interval.

In another embodiment, the LED printer according to any of the foregoing embodiments is characterized in that the printing control circuit adjusts the printing timings of the first portion LED head and the second portion LED head based on a transport speed of the non-printing medium to control a position of an image printed by the first portion LED head and a position of an image printed by the second portion LED head on the photosensitive drum to be aligned in the sub scanning direction.

In another embodiment, the LED printer according to the first aspect of the present invention further comprises: first memory for outputting print data to the first LED head according to an instruction from the printing control circuit; a second memory for outputting print data to the second LED head according to an instruction from the printing control circuit; and a data delay circuit for outputting, to the first memory, the print data delayed by the number of scanning lines based on the LED head interval to perform delay control at a unit of the scanning line interval, the LED printer being characterized in that the printing control circuit performs control for changing a timing for outputting the print data from the first memory to the first LED head and an exposure timing of the first LED head based on the detected position and control for changing a timing for outputting the print data from the second memory to the second LED head and an exposure timing of the second LED head based on the detected position, to control a delay with a width narrower than the scanning line interval.

According to the present invention, the circuit capable of delaying the print timing is provided for each of the LED heads of the separation type LED head. The printing position of each of the LED heads is adjusted according to the change of the exposure cycle of the separation type LED head. Therefore, even in the case of the LED printer using the separation type LED head, an effect is obtained in which the print length in each of the front end region and the rear end region of the sheet can be corrected to perform high-precision printing.

DETAIL DESCRIPTION OF THE PREFERRED EMBODIMENTS

<Principles>

Figure 1:
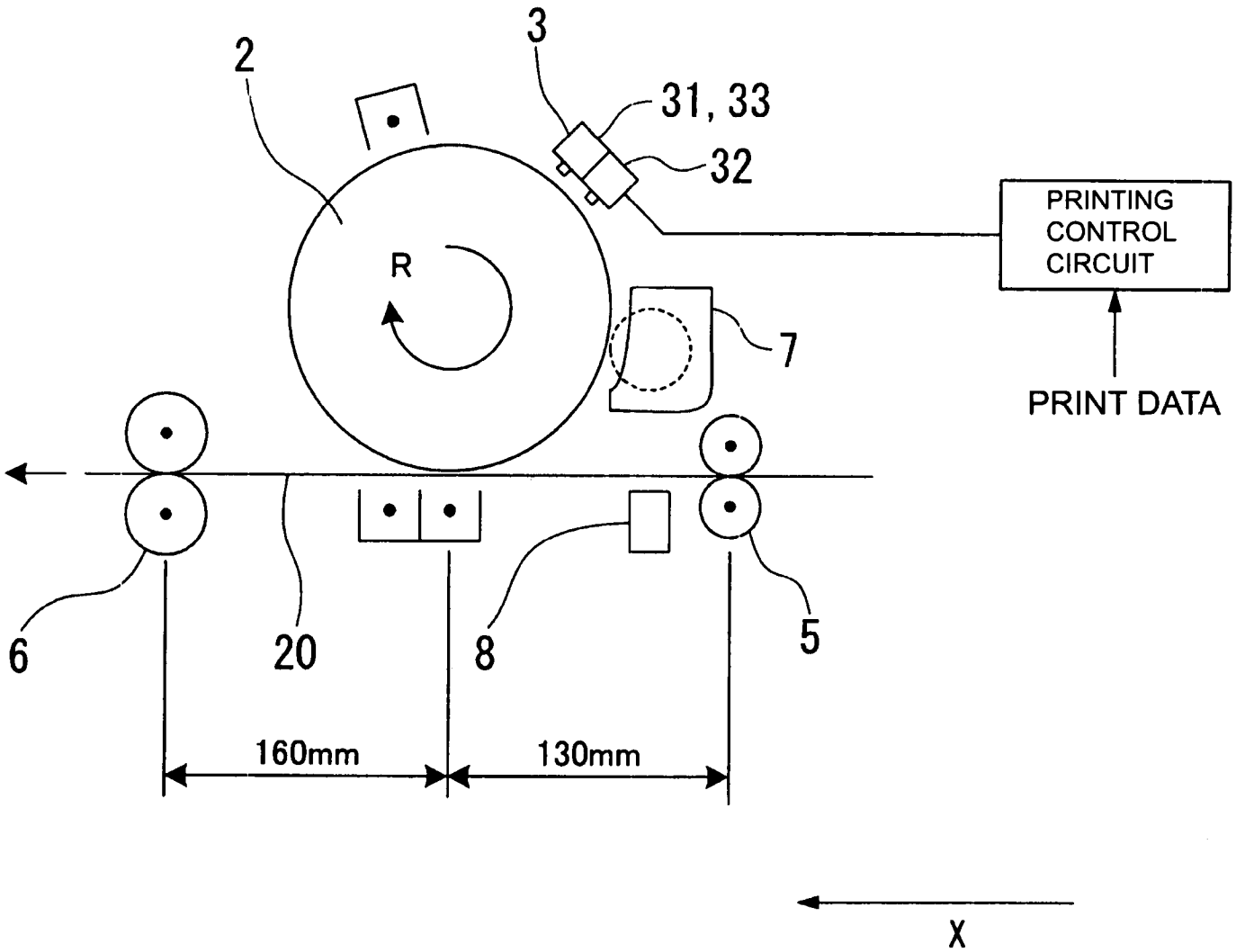
FIG. 1 is a block diagram showing a structure of an LED printer according to an embodiment of the present invention.

When printing is to be performed on a front end region of a sheet, a printing control circuit corrects a print length such that an exposure timing of an LED head of a separation type LED head, which is disposed on the front side in a sub scanning direction, is delayed relative to an exposure timing of an LED head thereof which is disposed on the rear side, to make an exposure cycle of the front end region of the sheet longer than an exposure cycle of a central region thereof, that is, to lengthen a print in the sub scanning direction.

When the print length is corrected by the printing control circuit as described above, the printing can be performed while a printing position of the LED head which is disposed on the front side is brought closer to a printing position of the LED head which is disposed on the rear side. Therefore, even when the printing is to be performed on the front end region of the sheet, a print deviation can be reduced.

In contrast this, when printing is to be performed on a rear end region of the sheet, the printing control circuit corrects the print length such that the exposure timing of the LED head of the separation type LED head, which is disposed on the rear side in the sub scanning direction, is delayed relative to the exposure timing of the LED head thereof which is disposed on the front side, to make the exposure cycle of the rear end region of the sheet shorter than the exposure cycle of the central region thereof, that is, to shorten the print in the sub scanning direction.

When the print length is corrected by the printing control circuit as described above, the printing can be performed while the printing position of the LED head which is disposed on the rear side is brought closer to the printing position of the LED head which is disposed on the front side. Therefore, even when the printing is to be performed on the rear end region of the sheet, the print deviation can be reduced.

Further, the printing control circuit includes a circuit capable of delaying a print timing which is provided for each of the LED heads of the separation type LED head. Therefore, the printing position of each of the LED heads can be adjusted according to the change of the exposure cycle of the separation type LED head.

Further, the printing control circuit includes FIFO circuits for temporarily holding print data for the separation LED heads and counter circuits for adjusting the exposure timings stepwise.

Further, the separation type LED head (separated into three) will be described. LED heads which are included in the separation type LED head and disposed on the front side in a rotational direction of a photosensitive drum are referred to as an LED head-A and an LED head-C. An LED head disposed on the rear side is referred to as an LED head-B.

In other words, the LED head-A and the LED head-C are disposed at the same position in the rotational direction of the photosensitive drum. The LED head-A, the LED head-B, and the LED head-C are arranged in a staggered manner.

Next, an operation of the printing control circuit will be described with reference to FIGS. 4 to 6.

Figure 4:
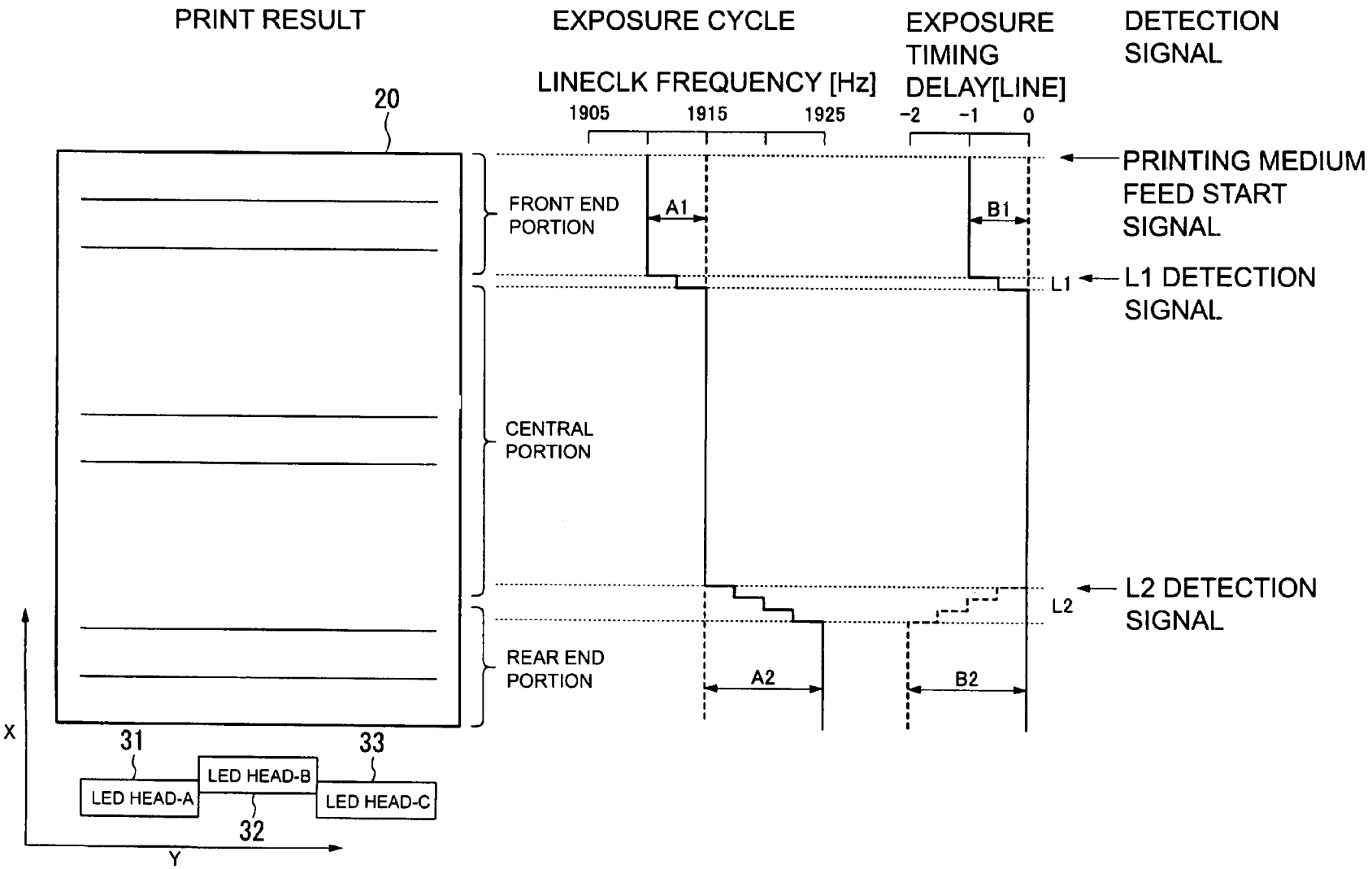
FIG. 4 is an explanatory diagram for explaining principles of the present invention.

At the left edge of FIG. 4 shows the front end region, the central region, and the rear end region on the sheet on which printing is performed by the printing control circuit.

Further, FIG. 4 shows the exposure cycle of the printing control circuit which is set for each of the regions of the print result in the left edge of FIG. 4. Further, FIG. 4 shows the exposure timing delay of the LED head-A, the LED head-B, and the LED head-C in the printing control circuit. Further, FIG. 4 shows a printing medium feed start signal, an L1 detection signal, and an L2 detection signal, each of which is a detection signal as described later.

Figure 5:
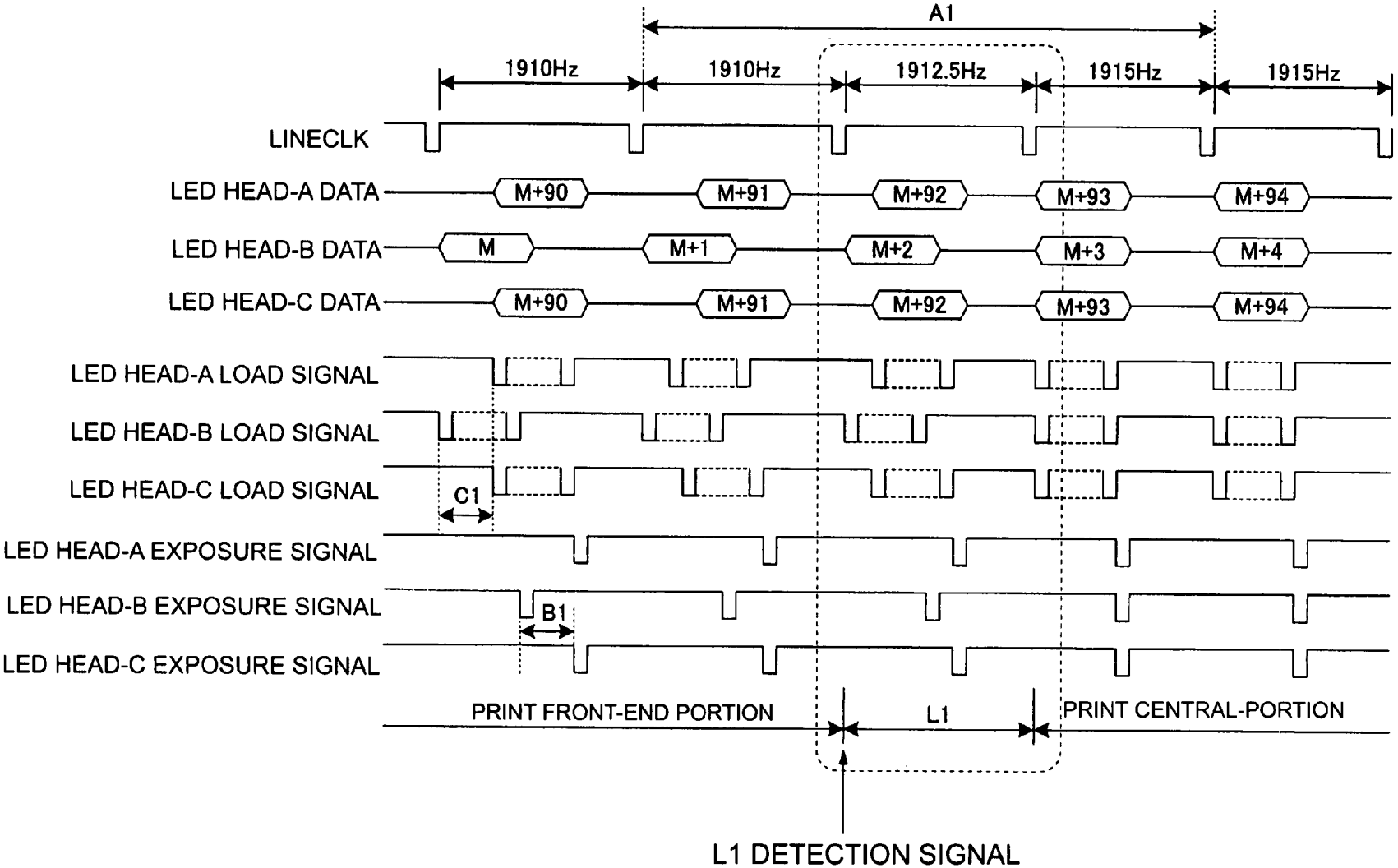
FIG. 5 is a sequence diagram showing an operation of the printing control circuit between a front end region and a central region.

FIG. 5 is an operational diagram showing the operation of the printing control circuit in the case where printing is performed from the front end region to the central region.

Figure 6:
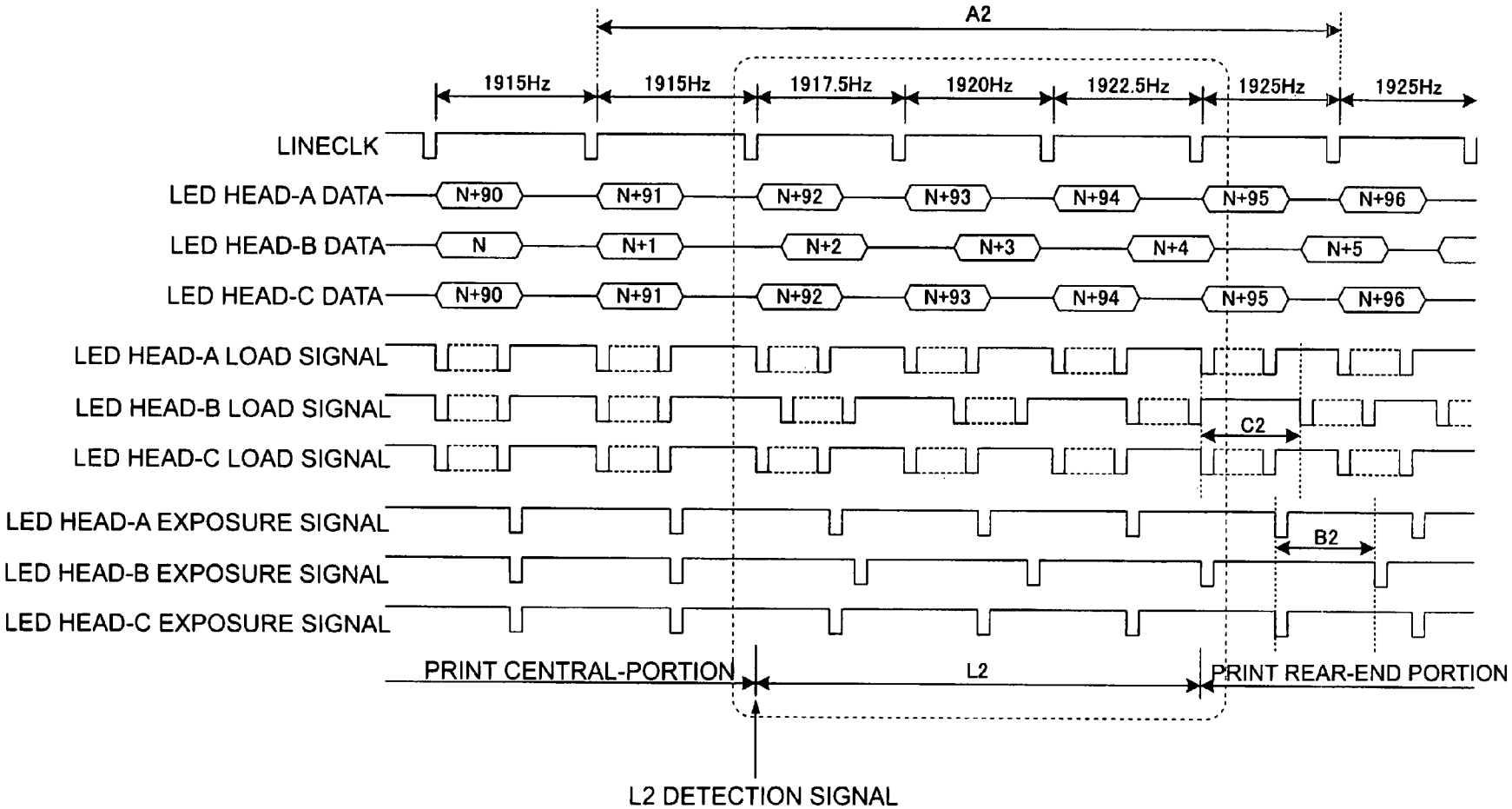
FIG. 6 is a sequence diagram showing an operation of the printing control circuit between the central region and a rear end region.

Further, FIG. 6 is an operational diagram showing the operation of the printing control circuit in the case where printing is performed from the central region to the rear end region.

When the printing is to be performed on the front end region of the sheet, the printing control circuit sets an exposure cycle longer than the exposure cycle of the central region (see A1 in FIGS. 4 and 5), causes printing control circuits provided for the LED head-A and the LED head-C to delay the readout of data from the FIFO circuits for temporarily holding the print data (see C1 in FIG. 5), and delays the exposure timings of the LED head-A and the LED head-C relative to the exposure timing of the LED head-B by the operation of the counter circuits (see B1 of FIGS. 4 and 5).

Therefore, even when the printing is being performed on the front end region of the sheet, a print deviation between the LED heads can be prevented without depending on a transport speed of the sheet.

Further, when the printing is to be performed on the rear end region of the sheet, the printing control circuit sets an exposure cycle shorter than the exposure cycle of the central region (see A2 in FIGS. 4 and 5), causes a printing control circuit provided for the LED head-B to delay the readout of data from the FIFO circuit for temporarily holding the print data (see C2 of FIG. 6) and delays the exposure timing of the LED head-B relative to the exposure timings of the LED head-A and the LED head-C by the operation of the counter circuit (see B2 of FIGS. 4 and 6).

Therefore, even when the printing is being performed on the rear end region of the sheet, a print deviation between the LED heads can be prevented without depending on the transport speed of the sheet.

Further, printing is performed on the central region of the sheet at a reference exposure cycle. Exposure using the LED head-A, the LED head-C, and the LED head-B is performed at a reference timing by the printing control circuits provided for the LED head-A, the LED head-C, and the LED head-B control (see FIGS. 4, 5, and 6).

Therefore, even when the printing is being performed on the central region of the sheet, a print deviation between the LED heads can be prevented without depending on the transport speed of the sheet.

Note that, when the exposure timings of the LED head-A and the LED head-C are to be switched between the front end region of the sheet and the central region thereof, two or more separate settings for the printing control circuits are performed for each main scanning line to gradually shift the exposure timings, thereby preventing a switching deviation from occurring (see L1 and L2 of FIG. 4, L1Of FIG. 5, and L2 of FIG. 6).

As described above, when the exposure cycle and the exposure timings of the LED heads are adjusted for printing for each of the front end region, the central region, and the rear end region of the sheet, a print deviation between the LED heads in each of the regions of the sheet can be prevented without depending on the transport speed of the sheet.

First Embodiment

Hereinafter, an embodiment of the present invention will be described with reference to the drawings. FIG. 1 is a schematic block diagram showing a structure of an LED printer according to the embodiment of the present invention.

The LED printer includes a photosensitive drum 2, a resist roller 5, a fixing device 6, a resist sensor 8, a separation type LED head 3, a printing control circuit 1, and a developing device 7.

The photosensitive drum 2 rotates about a rotating shaft in the sub scanning direction X at a constant rotation rate. The resist roller 5 feeds a printing medium 20 to the photosensitive drum 2 at a first constant speed. The fixing device 6 discharges the printing medium 20 from the photosensitive drum 2 at a second constant speed.

The first constant speed is different from the second constant speed. The second constant speed is faster than the first constant speed.

Note that, the printing medium 20 is a medium on which printing is performed by the LED printer, and is, for example, a sheet or a film.

The resist sensor 8 outputs the printing medium feed start signal when it is detected that the printing medium 20 is fed to the resist roller 5.

The developing device 7 supplies toner onto an electrostatic latent image formed on the photosensitive drum 2 by the separation type LED head 3.

The separation type LED head 3 includes a first portion LED head and a second portion LED head. The first portion LED head and the second portion LED head are arranged parallel to a main scanning direction Y while end portions thereof are overlapped with each other at an LED head interval which is a predetermined interval in the sub scanning direction X.

Figure 2:
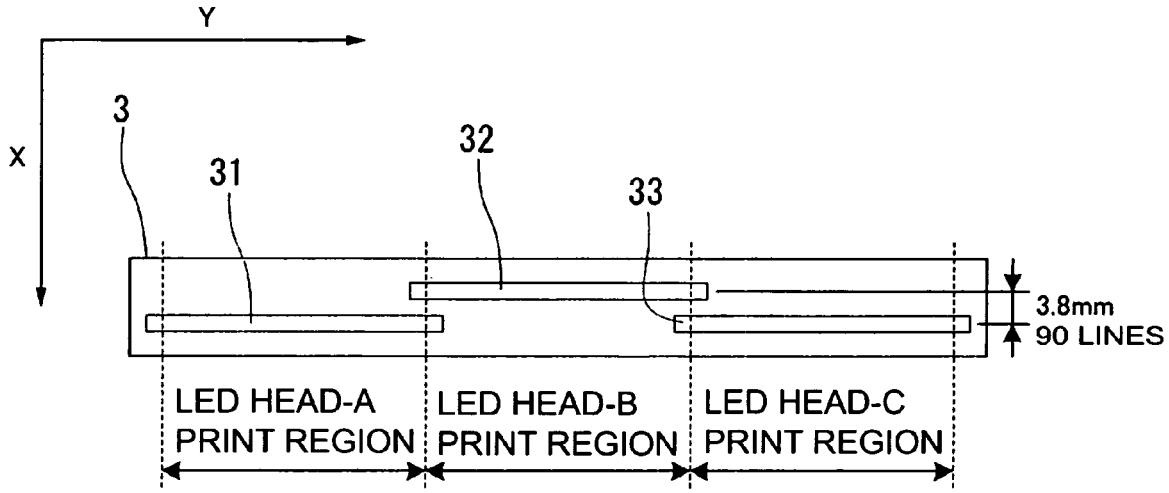
FIG. 2 is a structural diagram showing a structure of a separation type printing head of FIG. 1.

An example of the separation type LED head 3 will be described with reference to FIG. 2. In FIG. 2, portions corresponding to the respective portions of FIG. 1 are expressed by the same reference numerals and thus the description thereof is omitted here.

The separation type LED head 3 shown in FIG. 2 includes a small-size LED head-A 31, a small-size LED head-B 32, and a small-size LED head-C 33. The respective LED head-A 31 and 32 are arranged parallel to the main scanning direction Y. The respective LED heads are disposed such that parts of the end portions thereof are overlapped with each other in the sub scanning direction X. The LED head-A 31 and the LED head-C 33 are disposed at the same. position in the sub scanning direction X. The LED head-B 32 is shifted so as not to overlap with the LED head-A 31 and the LED head-C 33 in the sub scanning direction X.

As described above, the separation type LED head 3 has the structure in which the small-size LED heads (LED-head-A 31, LED head-B 32, and LED head-C 33) are arranged to be shifted in the main scanning direction Y and the sub scanning direction X. The small-size LED heads are shifted in the sub scanning direction X by several mm to several cm, so reference printing positions thereof in the sub scanning direction X are different from each other.

Each of the reference printing positions is an emission position to which LED light for printing is emitted from each of the LED heads and corresponds to, for example, a center position of each of the LED heads in the sub scanning direction X.

With respect to the first portion LED head and the second portion LED head as described above, the first portion LED head of FIG. 2 includes the LED head-A 31 and the LED head-C 33 and the second portion LED head includes the LED head-B 32.

Alternatively, with respect to the first portion LED head and the second portion LED head, the first portion LED head of FIG. 2 includes the LED head-B 32 and the second portion LED head includes the LED head-A 31 and the LED head-C 33.

The separation type LED head 3 performs exposure on the surface of the photosensitive drum 2 to print the print data inputted from the outside on the printing medium 20, under the control of the printing control circuit 1.

The printing control circuit 1 changes the exposure cycle of the separation type LED head 3 based on the LED head interval of the separation type LED head 3 and the printing medium feed start signal detected by the resist sensor 8 to adjust the print timings of the first portion LED head and the second portion LED head and causes the separation type LED head 3 to emit the LED light to the photosensitive drum 2, thereby printing the print data inputted from the outside.

Figure 3:
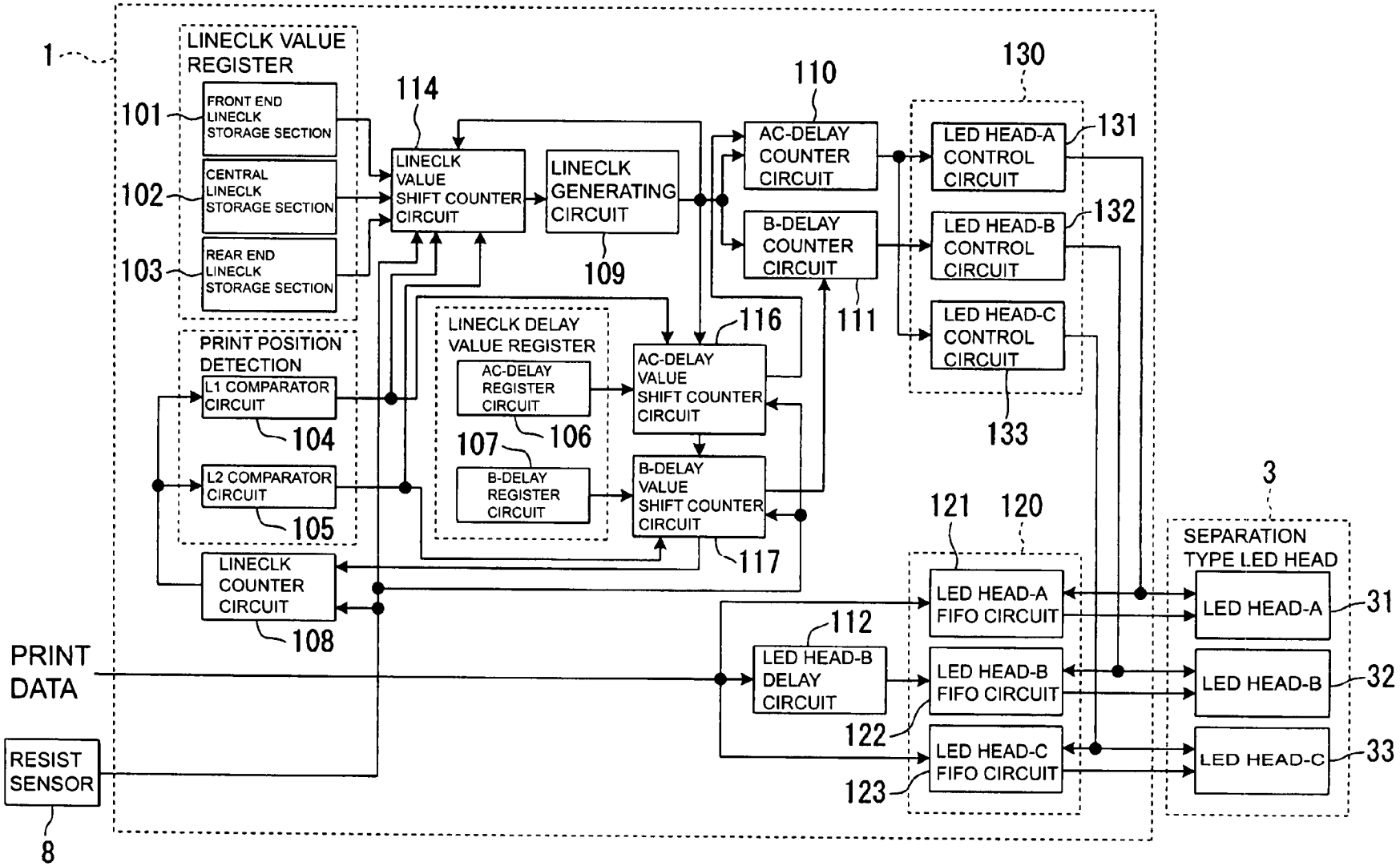
FIG. 3 is a structural diagram showing a structure of a printing control circuit of FIG. 1 according to a first embodiment.

Next, a structure of the printing control circuit 1 will be described with reference to FIG. 3. In FIG. 3, portions corresponding to the respective portions of FIG. 1 are expressed by the same reference numerals and thus the description thereof is omitted here.

The printing control circuit 1 includes a front end LINECLK storage section 101, a central LINECLK storage section 102, a rear end LINECLK storage section 103, an L1 comparator circuit 104, an L2 comparator circuit 105, an AC delay register circuit 106, a B-delay register circuit 107, an AC delay value shift counter circuit 116, a B-delay value shift counter circuit 117, an AC delay counter circuit 110, a B-delay counter circuit 111, an LINECLK value shift counter circuit 114, an LINECLK generating circuit 109, an LED head-B delay circuit 112, an LED head control circuit 130, and an LED head FIFO circuit 120.

The LED head-B delay circuit 112 (print data delay section) delays one of the print data simultaneously printed by the first portion LED head and the second portion LED head based on the LED head interval.

For example, the LED head-B delay circuit 112 delays, of the print data inputted from the outside, only print data to be printed by the LED head-B 32, by 90 lines.

The LED head FIFO circuit 120 (print data delay section) is a circuit for temporarily storing the one of the print data simultaneously printed by the first portion LED head and the second portion LED head which is delayed based on the LED head interval by the LED head-B delay circuit 112.

The LED head FIFO circuit 120 is, for example, a first-in first-out (FIFO) circuit.

The LED head FIFO circuit 120 includes an LED head-A FIFO circuit 121, an LED head-B FIFO circuit 122, and an LED head-C FIFO circuit 123.

The LED head-A FIFO circuit 121 is an FIFO circuit for storing the print data printed by the LED head-A 31. The LED head-B FIFO circuit 122 is an FIFO circuit for storing the print data printed by the LED head-B 32. The LED head-C FIFO circuit 123 is an FIFO circuit for storing the print data printed by the LED head-C 33.

The LED head-A FIFO circuit 121, the LED head-B FIFO circuit 122, and the LED head-C FIFO circuit 123 have identical structures.

As shown in FIG. 3, when only the LED head-B delay circuit 112 is provided and the print data to be printed by the LED head-B 32 is delayed by the LED head-B delay circuit 112, print data which is not delayed is stored in each of the LED head-A FIFO circuit 121 and the LED head-C FIFO circuit 123 and print data delayed based on the LED head interval is stored in the LED head-B FIFO circuit 122.

In the case where the LED head-B delay circuit 112 delays, of the print data inputted from the outside, only the print data printed by the LED head-B 32, by 90 lines as in the example described above, when print data of a line number M (M is a natural number) is assumed to be stored as the print data which is not delayed in each of the LED head-A FIFO circuit 121 and the LED head-C FIFO circuit 123, print data of a line number (M+90) which is the delayed print data is stored in the LED head-B FIFO circuit 122.

As described above, the print data delayed based on the LED head interval is stored in the LED head FIFO circuit 120 for each of the LED head-A 31, the LED head-B 32, and the LED head-C 33. When the stored print data are simultaneously printed, the LED printer can perform joint correction even in the case where there is the LED head interval. In this embodiment, as described later, not only in the case where the stored print data are simultaneously printed but also in the case where the print timings of the LED head-A 31, the LED head-B 32, and the LED head-C 33 are adjusted based on a displacement amount of the separation type LED head 3, even when the photosensitive drum is decentered, printing can be performed without a deviation of print joint.

The case where only the LED head-B delay circuit 112 corresponding to the LED head-B 32 is used is described here. There is also the case where an interval in the sub operation direction occurs between the LED head-A 31 and the LED head-C 35. In such a case, the LED head-A delay circuit corresponding to the LED head-A 31 and the LED head-C delay circuit corresponding to the LED head-C 33, which are similar to the LED head-B delay circuit 112, can be also provided. Further, an LED head delay circuit corresponding to each of the LED heads may be provided based on an interval from a predetermined reference position.

Returning to the description of FIG. 3, the LINECLK generating circuit 109 (line clock generating circuit) includes a line clock set frequency storage section.

The line clock set frequency storage section stores a line clock set frequency which is a frequency of a line clock pulse signal corresponding to a reference print timing of the separation type LED head 3.

The LINECLK generating circuit 109 generates the line clock pulse signal at the line clock set frequency stored in the line clock set frequency storage section.

A LINECLK counter circuit (line clock pulse signal counter circuit) 108 counts the line clock pulse signal generated by the LINECLK generating circuit 109 as a line clock pulse signal count value and stores the line clock pulse signal count value.

The LINECLK counter circuit 108 sets the line clock pulse signal count value to, for example, 0 to perform initialization when the printing medium feed start signal is inputted thereto.

The L1 comparator circuit 104 includes a first boundary value storage section. The first boundary value storage section stores a first line clock pulse signal counter value corresponding to a boundary position between the front end region in which the printing medium 20 is transported by only the resist roller 5 and the central region in which the printing medium 20 is transported by the resist roller 5 and the fixing device 6.

The L1 comparator circuit 104 compares the line clock pulse signal count value counted by the LINECLK counter circuit 108 with the first line clock pulse signal counter value to output the L1detection signal to the AC delay value shift counter circuit 116 when the comparison result is matched.

Note that, the first line clock pulse signal counter value is a value determined based on a distance between the resist roller 5 and the fixing device 6.

The L2 comparator circuit 105 includes a second boundary value storage section. The second boundary value storage section stores a second line clock pulse signal counter value corresponding to a boundary position between the central region in which the printing medium 20 is transported by the resist roller 5 and the fixing device 6 and the rear end region in which the printing medium 20 is transported by only the fixing device 6.

The L2 comparator circuit compares the line clock pulse signal count value counted by the LINECLK counter circuit 108 with the second line clock pulse signal counter value to output the L2 detection signal to the B-delay value shift counter circuit 117 when the comparison result is matched.

Note that, the second line clock pulse signal counter value is a value determined based on a size of the printing medium 20, that is, a length of the printing medium 20 in the sub scanning direction.

For example, the size of the printing medium 20 or the length thereof in the sub scanning direction is inputted to an input section for inputting the size of the printing medium 20, which is not shown. The input section causes the second boundary value storage section to store the second line clock pulse signal counter value based on the inputted size or length in the sub scanning direction.

A line clock set frequency correction circuit includes the front end LINECLK storage section 101, the central LINECLK storage section 102, the rear end LINECLK storage section 103, and the LINECLK value shift counter circuit 114 and adjusts the line clock set frequency stored in the line clock set frequency storage section in response to the input of the L1 detection signal or the L2 detection signal, corresponding to the front end region, the central region, or the rear end region.

The front end LINECLK storage section 101 (front end region set frequency storage section) stores a front end region set frequency (for example, 1910 Hz) which is a set frequency for the front end region.

The central LINECLK storage section 102 (central region set frequency storage section) stores a central region set frequency (for example, 1915 Hz) which is a set frequency for the central region.

The rear end LINECLK storage section 103 (rear end region set frequency storage section) stores a rear end region set frequency (for example, 1925 Hz) which is a set frequency for the rear end region.

The LINECLK value shift counter circuit 114 causes the line clock set frequency storage section to store the front end region set frequency read from the front end LINECLK storage section 101 in response to the input of the printing medium feed start signal.

Further, the LINECLK value shift counter circuit 114 causes the line clock set frequency storage section to store the central region set frequency read from the central LINECLK storage section 102 in response to the input of the L1 detection signal.

Further, the LINECLK value shift counter circuit 114 causes the line clock set frequency storage section to store the rear end region set frequency read from the rear end LINECLK storage section 103 in response to the input of the L2 detection signal.

In addition, the LINECLK value shift counter circuit 114 causes the line clock set frequency storage section to store set frequencies stepwise changed between the front end region set frequency and the central region set frequency in response to the input of the L1 detection signal.

For example, upon receiving the L1 detection signal, every time the line clock pulse signal is inputted, the LINECLK value shift counter circuit 114 calculates, of frequencies between the front end region set frequency and the central region set frequency, set frequencies by adding predetermined values to the front end region set frequency stepwise, to change the set frequency between the front end region set frequency and the central region set frequency stepwise.

Further, the LINECLK value shift counter circuit 114 causes the line clock set frequency storage section to store set frequencies stepwise changed between the central region set frequency and the rear end region set frequency in response to the input of the L2detection signal.

For example, upon receiving the L2 detection signal, every time the line clock pulse signal is inputted, the LINECLK value shift counter circuit 114 calculates, of frequencies between the central region set frequency and the rear end region set frequency, set frequencies by adding predetermined values to the central region set frequency stepwise, to change the set frequency between the central region set frequency and the rear end region set frequency stepwise.

The AC delay register circuit 106 (front end delay time storage section) stores a print delay time (for example, −1 line) in the front end region as a front end print delay time.

The AC delay value shift counter circuit 116 (first delay time calculation section) calculates a first delay time between the generation of the line clock pulse signal and the printing made by the first portion LED head in response to the input of the L1detection signal.

The AC delay value shift counter circuit 116 sets the front end print delay time read from the AC delay register circuit 106 as the first delay time in response to the input of the printing medium feed start signal and sets a value of the first delay time to 0 in response to the input of the L1 detection signal.

Further, the AC delay value shift counter circuit 116 calculates the first delay time between the front end print delay time and a delay time value of 0 stepwise in response to the L1detection signal.

For example, upon receiving the L1 detection signal, every time the line clock pulse signal is inputted, the AC delay value shift counter circuit 116 subtracts predetermined values from the front end print delay time step wise until the delay time value reaches 0 from the front end print delay time, to calculate the first delay time between the value of the front end print delay time and the value of 0 stepwise.

The B-delay register circuit 107 (rear end delay time storage section) stores a print delay time (for example, −2 line) in the rear end region as a rear end print delay time.

The B-delay value shift counter circuit 117 (second delay time calculation section) calculates a second delay time between the generation of the line clock pulse signal and the printing made by the second portion LED head in response to the input of the L2detection signal.

The B-delay value shift counter circuit 117 sets the second delay time to 0 in response to the input of the printing medium feed start signal and sets the rear end print delay time read from the B-delay register circuit 107 as the second delay time in response to the input of the L2 detection signal.

The B-delay value shift counter circuit 117 calculates the second delay time between a value of 0 and the rear end print delay time stepwise in response to the input of the L2 detection signal.

For example, upon receiving the L2 detection signal, every time the line clock pulse signal is inputted, the B-delay value shift counter circuit 117 adds predetermined values to the value of 0 to the rear end print delay time stepwise, to calculate the second delay time between the value of 0 and the rear end print delay time stepwise.

A first LED head control circuit which is composed of the AC delay counter circuit 110 and the LED head control circuit 130 delays the printing made by the first portion LED head by the first delay time calculated by the AC delay value shift counter circuit 116 from the input of the line clock pulse signal generated by the LINECLK generating circuit 109.

To be specific, the AC delay counter circuit 110 delays a control signal AC by the first delay time calculated by the AC delay value shift counter circuit 116 from the input of the line clock pulse signal generated by the LINECLK generating circuit 109 and outputs the control signal AC to the LED head control circuit 130. After that, the LED head control circuit 130 to which the control signal AC is inputted causes the first portion LED head to print.

A second LED head control circuit which is composed of the B-delay counter circuit 111 and the LED head control circuit 130 delays the printing made by the second portion LED head by the second delay time calculated by the B-delay value shift counter circuit 117 from the line clock generated by the LINECLK generating circuit 109.

To be specific, the B-delay counter circuit 111 delays a control signal B by the second delay time calculated by the B-delay value shift counter circuit 117 from the input of the line clock pulse signal generated by the LINECLK generating circuit 109 and outputs the control signal B to the LED head control circuit 130. After that, the LED head control circuit 130 to which the control signal B is inputted causes the second portion LED head to print.

Upon receiving the control signal AC outputted from the AC delay counter circuit 110 or the control signal B outputted from the B-delay counter circuit 111, the LED head control circuit 130 outputs, an LED head load signal for transmitting print data from the LED head FIFO circuit 120 to the separation type LED head 3 in response to the inputted control signal AC or the control signal B. After the transmission of the print data from the LED head FIFO circuit 120 to the separation type LED head 3 is completed, the LED head control circuit 130 outputs, to the separation type LED head 3, an LED head exposure signal for performing exposure using the separation type LED head 3.

The LED head control circuit 130 includes an LED head-A control circuit 131, an LED head-B control circuit 132, and an LED head-C control circuit 133.

The LED head-A control circuit 131 is a control circuit for controlling the LED head-A 31. The LED head-B control circuit 132 is a control circuit for controlling the LED head-B 32. The LED head-C control circuit 133 is a control circuit for controlling the LED head-C 33.

Further, the LED head-A control circuit 131, the LED head-B control circuit 132, and the LED head-C control circuit 133 have identical structures.

Note that the different point is that the control signal AC is inputted from the AC delay counter circuit 110 to the LED head-A control circuit 131 and the LED head-C control circuit 133 and the control signal B is inputted from the B-delay counter circuit 111 to the LED head-B control circuit 132.

Next, the control operation among the LED head control circuit 130, the LED head FIFO circuit 120, and the separation type LED head 3 will be described in detail.

Each of the LED head control circuit 130, the LED head FIFO circuit 120, and the separation type LED head 3 has the same structure with respect to the LED head-A 31, the LED head-B 32, and the LED head-C 33.

Therefore, the LED head-A control circuit 131 of the LED head control circuit 130 which is provided corresponding to the LED head-A 31 and the LED head-A FIFO circuit 121 of the LED head FIFO circuit 120 which is provided corresponding to the LED head-A 31 will be described here.

The LED head-A control circuit 131 outputs an LED head-A load signal having a predetermined time length to the LED head-A FIFO circuit 121 and the LED head-A 31 in response to the input of the control signal AC from the AC delay counter circuit 110. After the output of the LED head-A load signal is completed, an LED head-A exposure signal is outputted to the LED head-A 31.

The predetermined time length of the LED head-A load signal outputted from the LED head-A control circuit 131 is a time length determined based on a time length in which the print data is transferred from the LED head-A FIFO circuit 121 to the LED head-A 31.

The LED head-A FIFO circuit 121 transmits the stored print data to the LED head-A 31 in response to the input of the LED head-A load signal from the LED head-A control circuit 131. The transmitted print data is removed from the LED head-A FIFO circuit 121.

On the other hand, the LED head-A 31' stores the print data transmitted from the LED head-A FIFO circuit 121 in response to the input of the LED head-A load signal from the LED head-A control circuit 131 in an internal storage section of the LED head-A 31.

Then, the LED head-A 31 performs exposure of the print data stored in the internal storage section of the LED head-A 31 on the photosensitive drum 2 in response to the input of the LED head-A exposure signal from the LED head-A control circuit 131.

The above LED printer as a whole executes printing by the operation described in <Principles>.

According to the above-mentioned structure, the print data is delayed by the LED head delay circuit B 112, so correction can be made to change the exposure timing between the respective LED heads by a distance between lines in the sub scanning direction. In addition, the exposure timing between the respective LED heads is changed by the LED head control circuit 130, so shorter-distance adjustment can be performed for fine correction. With respect to the exposure timing, the resolution of the exposure timing can be determined based on the frequency of the LINECLK generating circuit 109. According to an example of this embodiment, with respect to LINECLK, the frequency in the central portion is 1915 Hz, the frequency in the front end is 1910 Hz, and the frequency in the rear end is 1925 Hz. The frequency is changed in a stepwise manner by 2.5 Hz, with the result that slight deviation can be corrected. When exposure timing data corresponding to a sheet transport speed and a sheet transport position is stored as a table in a memory and the exposure timing is changed corresponding to the detected sheet transport speed and the detected sheet transport position, joint between the LED heads can be more accurately performed.

In addition, when the correction is performed by only the LED head control circuit 130, the slight deviation can be also corrected. Therefore, when the correction is to be performed by a large line width, the registers, the counters, and the like become very large in size. When the correction is performed in advance in the large line width by the LED head delay circuit B 112, the registers, the counters, and the like can be reduced in size, so a circuit scale can be reduced.

Figure 7:
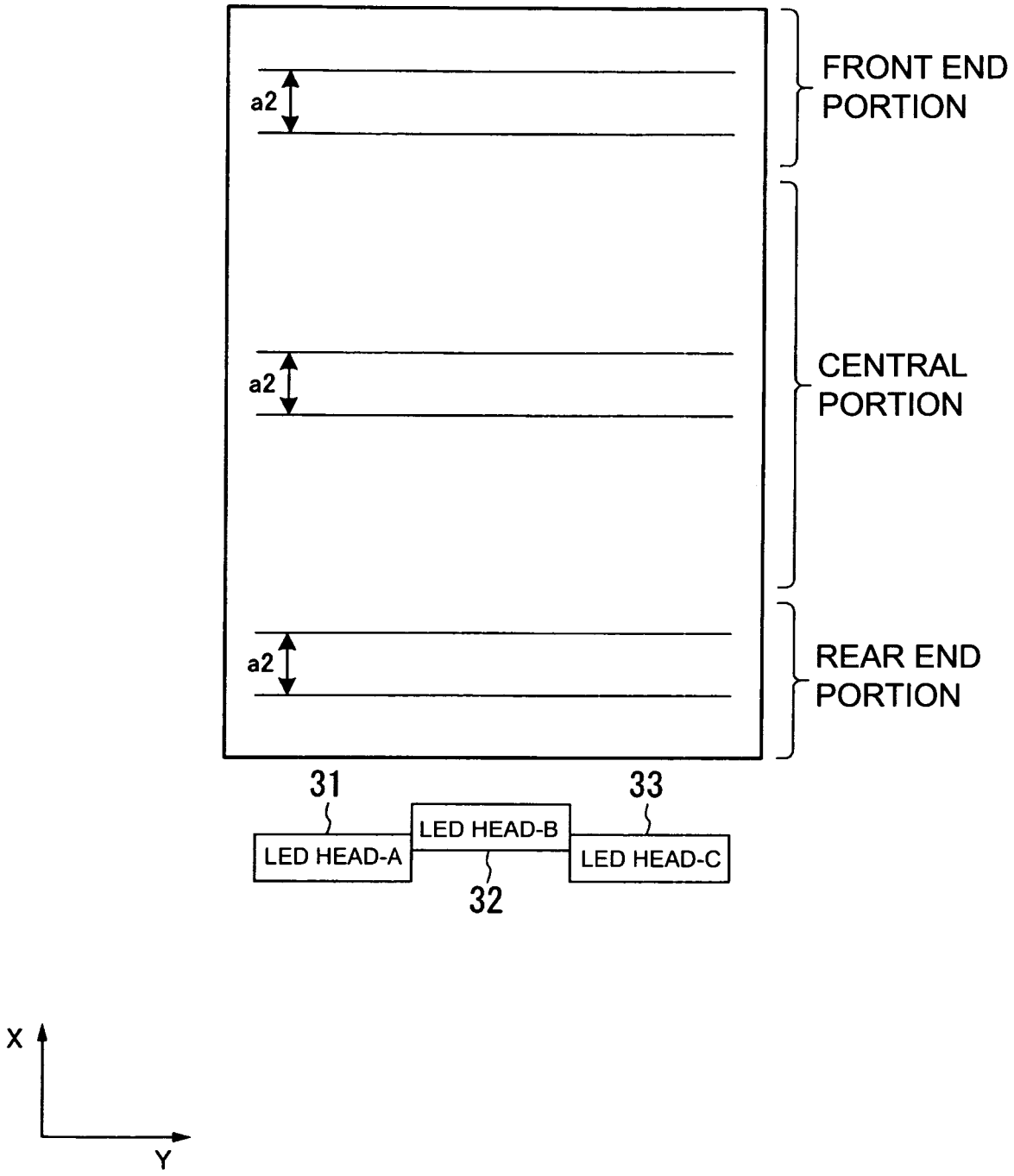
FIG. 7 is a diagram showing a print result by the LED printer according to the present invention.

As described above, the LED printer according to this embodiment includes the circuit capable of delaying the pint timing for each of the LED heads of the separation type LED head. The print position of each of the LED heads is adjusted corresponding to the change of the exposure cycle of the separation type LED head. Therefore, as shown in FIG. 7, even in the case of the LED printer using the separation type LED head, the print length in each of the front end region and the rear end region of the sheet can be corrected.

Second Embodiment

A second embodiment will be described with reference to FIG. 8.

In the first embodiment, the registers, the comparator circuits, and the shift register circuits are used. Instead of those, in the second embodiment, a central processing unit (CPU) 201, a random access memory (RAM) 202, and a read only memory (ROM) 203 are used.

The CPU 201 has functions which correspond to the LINECLK value shift counter circuit 114, the AC delay value shift counter circuit 116, the B-delay value shift counter circuit 117, the L1 comparator circuit 104, and the L2 comparator circuit 105.

The RAM 202 or the ROM 203 has functions which correspond to the front end LINECLK storage section 101, the central LINECLK storage section 102, and the rear end LINECLK storage section 103.

Figure 8:
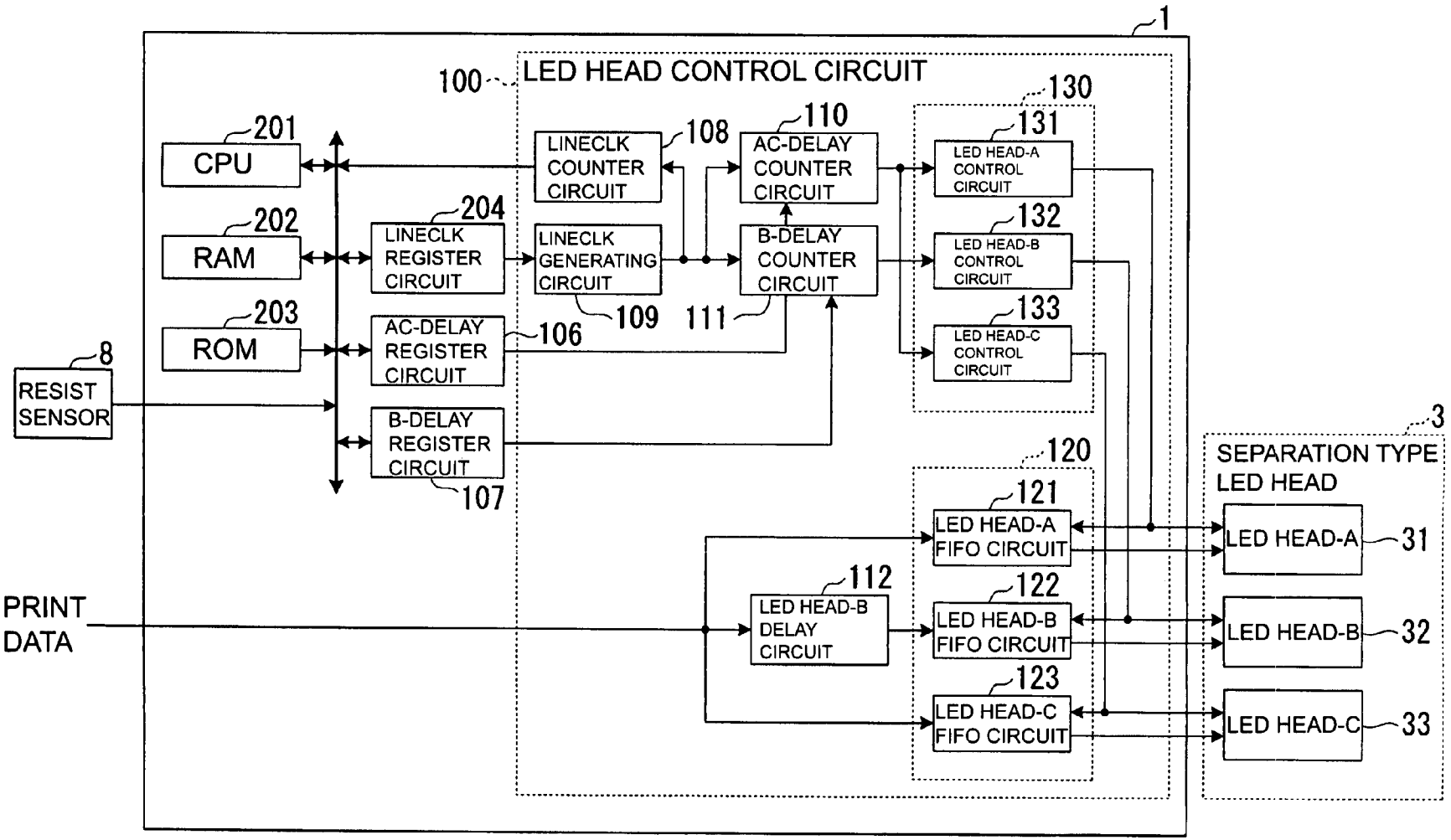
FIG. 8 is a structural diagram showing a structure of the printing control circuit of FIG. 1 according to a second embodiment.
Figure 9B:
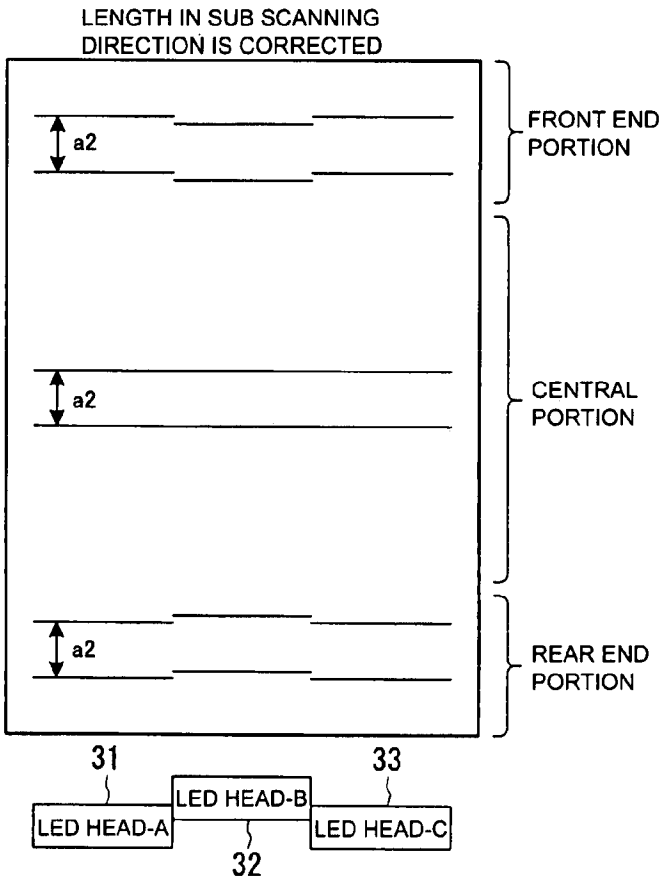
Fig.9B PRIOR ART
FIGS. 9A and 9B are diagrams showing a print result by a conventional LED printer.
Figure 9A:
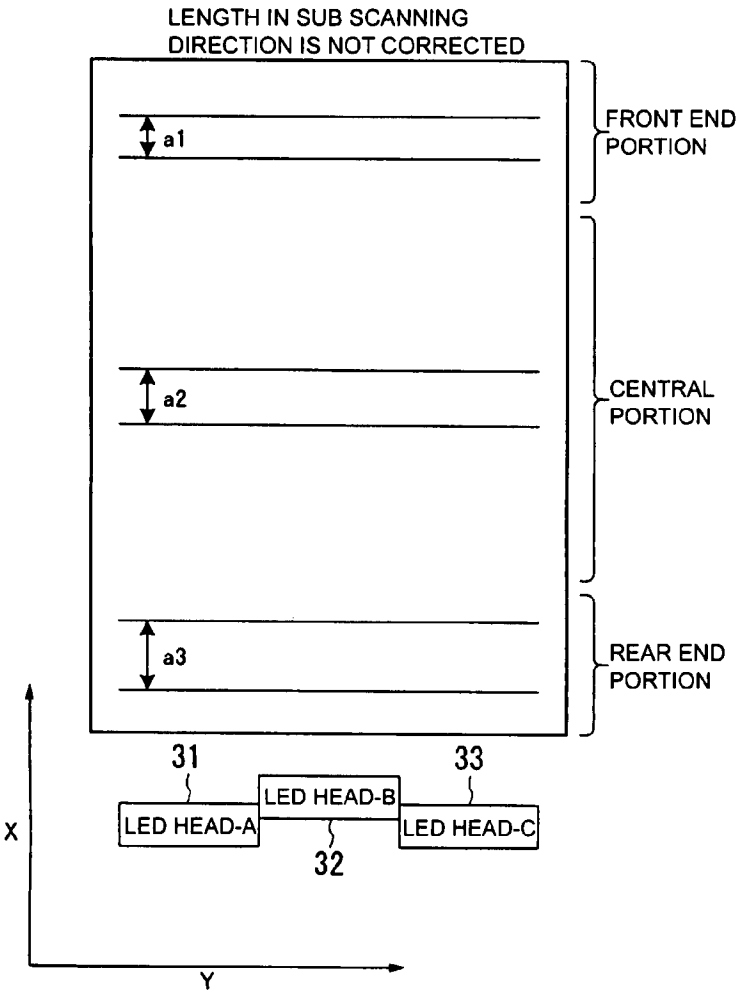
Fig.9A PRIOR ART

A LINECLK register circuit 204 shown in FIG. 8 corresponds to the line-clock set frequency storage section included in the LINECLK generating circuit 109. Therefore, the LINECLK generating circuit 109 shown in FIG. 8 does not include the line clock set frequency storage section.

As described above, the LED printer according to the present invention can be formed of the CPU 201, the RAM 202, and the ROM 203 without using the registers, the comparator circuits, and the shift register circuits.

Note that, every time the line clock pulse signal is inputted, each of the LINECLK value shift counter circuit 114, the AC delay value shift counter circuit 116, the B-delay value shift counter circuit 117, and the CPU 201, outputs a result obtained by subtracting or adding a predetermined value from a first value to a second value. Instead of this, values to be outputted may be stored in a storage section in advance and read from the storage section every time the line clock pulse signal is inputted.

For example, of frequencies between the front end region set frequency (for example, 1910 Hz) stored in the front end LINECLK storage section 101 and the central region set frequency (for example, 1915 Hz) stored in the central LINECLK storage section 102, set frequency values obtained by adding the front end region set frequency to predetermined frequency values in a stepwise manner are stored in order in a front end central set frequency storage section.

Next, for example, an LINECLK value generating circuit is provided corresponding to the function of the LINECLK value shift counter circuit 114. The LINECLK value generating circuit reads a set frequency value first stored in the front-end central set frequency storage section in response to the input of the printing medium feed start signal and outputs the read set frequency.

Then, the LINECLK value generating circuit reads a set frequency value secondly stored in the front-end central set frequency storage section in response to the input of the L1 detection signal and outputs the read set frequency.

Subsequently, every time the line clock pulse signal is inputted, the LINECLK value generating circuit reads set frequency values stored in the front-end central set frequency storage section in order and outputs the read set frequencies.

The set frequency values may be stored in the front-end central set frequency storage section for each size of the printing medium 20 or each length thereof in the sub scanning direction and a value of the set frequency value may be selected based on the size of the printing medium 20 or the length thereof in the sub scanning direction which is set and inputted from the outside.

The example in the case where the storage section is used for only the LINECLK value shift counter circuit 114 is described. The same can be applied for the AC delay value shift counter circuit 116, the B-delay value shift counter circuit 117, or the CPU 201.

Note that, in the embodiments, when the printing is to be performed on the front end region of the sheet, the printing control circuit sets the exposure cycle longer than the exposure cycle of the central region to delay the exposure timing of each of the LED head-A and the LED head-C relative to the exposure timing of the LED head-B. In contrast to this, the exposure timing of each of the LED head-A and the LED head-C may be made faster than the exposure timing of the LED head-B.

In such a case, even when the printing is being performed on the rear end region of the sheet, a print deviation between the LED heads can be prevented without depending on the transport speed of the sheet.

Further, in the embodiments, when the printing is to be performed on the rear end region of the sheet, the printing control circuit sets the exposure cycle shorter than the exposure cycle of the central region to delay the exposure timing of the LED head-B relative to the exposure timing of each of the LED head-A and the LED head-C. In contrast to this, the exposure timing of the LED head-B may be made faster than the exposure timing of each of the LED head-A and the LED head-C.

In such a case, even when the printing is being performed on the rear end region of the sheet, a print deviation between the LED heads can be prevented without depending on the transport speed of the sheet.

Note that, the printing control circuit 1 shown in FIG. 1 may be realized using specific hardware or realized using a memory and a microprocessor.

A program for realizing the respective functions of the printing control circuit 1 shown in FIG. 3 may be recorded on a computer-readable recording medium, a program for realizing the functions of the processing sections of the printing control circuit 1 may be recorded on the computer-readable recording medium, and the programs recorded on the recording medium may be read by a computer system and executed thereby to perform the processing to be executed by the printing control circuit 1. Note that the "computer system" may include hardware such as an OS and peripheral devices. The "computer system" further includes a homepage providing environment (or display environment) when a WWW system is employed. The "computer-readable recording medium" includes a flexible disk, a magneto-optical disk, a ROM, a writable nonvolatile memory such as a flash memory, a portable medium such as a CD-ROM, and a storage device such as a hard disk contained in the computer system.

Note that, in the present invention, the LED printer is described. The present invention is not limited to this and can be applied to a printer using a drum having a plurality of printing heads.

The embodiments of the present invention are described in detail with reference to the attached drawings. The specific structure is not limited to the embodiments and thus includes designs and the like made without departing from the gist of the present invention.

INDUSTRIAL APPLICABILITY

The present invention is suitable for a printer, in particular, a printer using a drum having a plurality of printing heads.

What is claimed is:

1. An LED printer comprising:

a photosensitive drum mounted to undergo rotation about a rotating shaft in a sub scanning direction;

a resist roller that feeds a printing medium to the photosensitive drum at a first constant speed;

a fixing device that discharges the printing medium from the photosensitive drum at a second constant speed different from the first constant speed;

a separation type LED head having a first portion LED head and a second portion LED head, the first portion LED head and the second portion LED head being arranged parallel to a main scanning direction at an LED head interval which is a predetermined interval in the sub scanning direction while end portions thereof are overlapped with each other, and the first portion LED head being disposed before the second portion LED head relative to the rotation of the photosensitive drum; and a printing control circuit that (a) detects a position of the printing medium fed by the resist roller or the fixing device, (b) adjusts printing timings of the first portion LED head and the second portion LED head based on the detected position and the LED head interval, (c) outputs a line clock pulse signal at a reference cycle corresponding to the LED head interval in the position of the printing medium in which the printing medium is fed by the resist roller and the fixing device, (d) sets print timings of the first portion LED head and the second portion LED head as a timing of the line clock pulse signal outputted at the reference cycle when the detected position is the position of the printing medium in which the printing medium is fed by the resist roller and the fixing device, (e) delays a cycle of the reference cycle and sets the print timing of the first portion LED head as a timing delayed by a predetermined time from the line clock pulse signal outputted at the delayed reference cycle, when the detected position is the position of the printing medium in which the printing medium is fed by only the resist roller, and (f)advances the cycle of the reference cycle and sets the print timing of the second portion LED head as a timing delayed by a predetermined time from the advanced reference cycle, when the detected position is the position of the printing medium in which the printing medium is fed by only the fixing device.

2. An LED printer according to claim 1; wherein the printing control circuit changes the cycle of the reference cycle in a stepwise manner.

3. An LED printer according to claim 2; wherein the printing control circuit changes the predetermined time for delaying or advancing from the line clock pulse signal in the stepwise manner.

4. An LED printer according to claim 1; wherein the printing control circuit changes the predetermined time for delaying or advancing from the line clock pulse signal in the stepwise manner.

5. A LED printer comprising:

a photosensitive drum mounted to undergo rotation about a rotating shaft in a sub scanning direction;

a resist roller that feeds a printing medium to the photosensitive drum at a first constant speed;

a fixing device that discharges the printing medium from the photosensitive drum at a second constant speed different from the first constant speed;

a separation type LED head having a first portion LED head and a second portion LED head, the first portion LED head and the second portion LED head being arranged parallel to a main scanning direction at an LED head interval which is a predetermined interval in the sub scanning direction while end portions thereof are overlapped with each other, and the first portion LED head being disposed before the second portion LED head relative to the rotation of the photosensitive drum; and a printing control circuit that (a) detects a position of the printing medium fed by the resist roller or the fixing device, (b) adjusts printing timings of the first portion LED head and the second portion LED head based on the detected position and the LED head interval, (c)outputs a line clock pulse signal at a reference cycle corresponding to the LED head interval in the position of the printing medium in which the printing medium is fed by the resist roller and the fixing device, (d) sets the print timing of each of the first portion LED head and the second portion LED head as a timing of the line clock pulse signal outputted at the reference cycle when the detected position is the position of the printing medium in which the printing medium is fed by the resist roller and the fixing device, (e)delays a cycle of the reference cycle and sets the print timing of the second portion LED head as a timing advanced by a predetermined time from the line clock pulse signal outputted at the delayed reference cycle, when the detected position is the position of the printing medium in which the printing medium is fed by only the resist roller, and (f)advances the cycle of the reference cycle and sets the print timing of the first portion LED head as a timing advanced by a predetermined time from the advanced reference cycle, when the detected position is the position of the printing medium in which the printing medium is fed by only the fixing device.

6. An LED printer according to claim 5; wherein the printing control circuit changes the cycle of the reference cycle in a stepwise manner.

7. An LED printer according to claim 6; wherein the printing control circuit changes the predetermined time for delaying or advancing from the line clock pulse signal in the stepwise manner.

8. An LED printer comprising:

a photosensitive drum mounted to undergo rotation about a rotating shaft in a sub scanning direction;

a resist roller that feeds a printing medium to the photosensitive drum at a first constant speed;

a fixing device that discharges the printing medium from the photosensitive drum at a second constant speed different from the first constant speed;

a separation type LED head having a first portion LED head and a second portion LED head, the first portion LED head and the second portion LED head being arranged parallel to a main scanning direction at an LED head interval which is a predetermined interval in the sub scanning direction while end portions thereof are overlapped with each other; and a printing control circuit that detects a position of the printing medium fed by the resist roller or the fixing device and that adjusts printing timings of the first portion LED head and the second portion LED head based on the detected position and the LED head interval, the printing control circuit comprising:

a line clock set frequency storage section that stores a line clock set frequency which is a frequency of a line clock pulse signal corresponding to a reference print timing of the separation type LED head;

a line clock generating circuit that generates the line clock pulse signal at the line clock set frequency;

a line clock pulse signal counter circuit that counts the line clock pulse signal as a line clock pulse signal count value;

a first boundary value storage section that stores a first line clock pulse signal counter value corresponding to a boundary position between a front end region in which the printing medium is transported by only the resist roller and a central region in which the printing medium is transported by the resist roller and the fixing device;

a second boundary value storage section that stores a second line clock pulse signal counter value corresponding to a boundary position between the central region and a rear end region in which the printing medium is transported by only the fixing device;

an L1 comparator circuit that compares the line clock pulse signal count value with the first line clock pulse signal counter value and that outputs an L1 detection signal when a comparison result is matched;

an L2 comparator circuit that compares the line clock pulse signal counter value with the second line clock pulse signal counter value and that outputs an L2 detection signal when a comparison result is matched;

a line clock set frequency correction circuit that adjusts the line clock set frequency stored in the line clock set frequency storage section in response to an input of the L1 detection signal or the L2 detection signal, corresponding to the front end region, the central region, or the rear end region;

a first delay time calculation section that calculates a first delay time between the line clock pulse signal and printing made by the first portion LED head in response to the input of the L1 detection signal;

a second delay time calculation section that calculates a second delay time between the line clock pulse signal and printing made by the second portion LED head in response to the input of the L2 detection signal;

a first LED head control circuit that delays the printing made by the first portion LED head by the calculated first delay time from an input of the line clock pulse signal generated by the line clock generating circuit; and a second LED head control circuit that delays the printing made by the second portion LED head by the calculated second delay time from the line clock generated by the line clock generating circuit.

* * * * *